US007883203B2

(12) United States Patent
Wang

(10) Patent No.: US 7,883,203 B2
(45) Date of Patent: Feb. 8, 2011

(54) DEVICE FOR PRINTING IMAGE AND CHARACTER ON A CANDLE

(76) Inventor: Hong Wang, No. 1009, Chongqing Middle Road, Licang District, Qingdao, Shandong 266043 (CN)

( * ) Notice: Subject to any disclaimer, the term of this patent is extended or adjusted under 35 U.S.C. 154(b) by 641 days.

(21) Appl. No.: 11/885,367

(22) PCT Filed: Nov. 13, 2006

(86) PCT No.: PCT/CN2006/003043

§ 371 (c)(1),
(2), (4) Date: Aug. 30, 2007

(87) PCT Pub. No.: WO2007/065343

PCT Pub. Date: Jun. 14, 2007

(65) Prior Publication Data

US 2008/0158326 A1 Jul. 3, 2008

(30) Foreign Application Priority Data

Dec. 9, 2005 (CN) ..... 2005 1 0045534

(51) Int. Cl.
*B41J 2/01* (2006.01)

(52) U.S. Cl. ..... 347/104; 347/110; 101/36; 101/38.1

(58) Field of Classification Search ..... 347/16, 347/101, 103–106, 110; 101/35, 36, 38.1
See application file for complete search history.

(56) References Cited

U.S. PATENT DOCUMENTS

| | | | | |
|---|---|---|---|---|
| 4,030,959 | A | 6/1977 | Meisner et al. | |
| 5,289,767 | A * | 3/1994 | Montalto et al. | 101/35 |
| 5,893,016 | A | 4/1999 | Landa et al. | |
| 6,823,780 | B2 | 11/2004 | Vogt et al. | |

FOREIGN PATENT DOCUMENTS

| | | |
|---|---|---|
| CN | 2327533 Y | 7/1999 |
| JP | 8-207265 | 8/1996 |
| JP | 2001-205794 | 7/2001 |

* cited by examiner

*Primary Examiner*—Daniel Petkovsek
(74) *Attorney, Agent, or Firm*—Frommer Lawrence & Haug LLP; Ronald R. Santucci

(57) ABSTRACT

A printer, especially a device for printing images and characters on a candle includes an inkjet-printing unit. The printing unit comprises a printing bracket on which a printing head is provided. The printing head may reciprocate linearly relative to the printing bracket. Two rotating shafts parallel with each other are arranged below the inkjet-printing unit. At least one of the rotating shafts connects with a driving device. The driving device and the inkjet-printing unit connect with a circuit broad. The device may be used to print golden, silvery, white, and color images and characters on a waxen surface, or used in combination with a computer having a strong image processing functionality to print color images and characters on the candle, meeting an individuation need of a person. The image may be online updated or self defined at all hours according to fashion and vogue.

10 Claims, 3 Drawing Sheets

DEVICE FOR PRINTING IMAGE AND CHARACTER ON A CANDLE

This application is a 371 of PCT/CN2006/003043 filed on Nov. 13, 2006, published on Jun. 14, 2006 under publication number WO 2007/065343 A1 which claims priority benefits from Chinese Patent Application Number 200510045534.7 filed Dec. 9, 2005, the disclosure of which is hereby incorporated by reference.

FIELD OF THE INVENTION

The present invention relates to the field of a printer, in particular to a device for printing images and/or characters on a candle.

BACKGROUND OF THE INVENTION

With the progress of society, artistic candles have increasingly become one kind of indispensable product in daily life throughout the world especially in occident. Artistic candles can be present to friends as popular gifts and can be laid out at public places, such as stores, supermarkets, shops and so on, as well as at home, so as to decorate environment and provide an attracting and romantic atmosphere. As the people pursue fashion and personalization with increasingly great enthusiasm, more and more artistic candles tend to be demanded as fashionable and individualized articles.

Artistic candles with various shapes and patterns are conventionally manufactured in batches in the industry and only common images and/or characters are printed on the candles, thus they can not meet personalized requirements of consumers. For example, it can not be realized if a consumer wants to print his/her name, photo or any self-defined images and/or characters on the candles, other than by customizing, but such customization will result in the high manufacturing cost and long manufacturing period and is not real-time since the amount of customization is very small.

A device for directly printing images and/or characters on a candle has not been known yet hitherto.

SUMMARY OF THE INVENTION

Correspondingly, the technical problem to be solved by the present invention is to provide a device for printing images and/or characters on a candle, which has rapid printing speed and can produce clear, pretty, colorful and fadeless patterns as desired so that the candle can be affective and romantic.

According to the present invention, there is provided a device for printing images and/or characters on a candle including: an inkjet-printing unit comprising a printing bracket on which a printing head is arranged, the printing head making a linear reciprocating movement relative to the printing bracket, two rotating shafts parallel with each other in a same horizontal plane being arranged below the inkjet-printing unit, the axes of the rotating shafts extending in the same direction as the reciprocating movement of the printing head, and a driving device being coupled with at least one of the rotating shafts, and the driving device and the inkjet-printing unit being coupled with a circuit board.

The rotating shafts are arranged on a holder, and both the horizontal distance between the rotating shafts and the vertical distance between the holder and the printing unit can be adjusted. The holder comprises two pairs of legs, each pair of which are symmetrically arranged in a "八" (Chinese character) shaped configuration and fixed to a housing. A Sliding slot is provided in the leg. The opposite ends of each rotating shaft are located in the corresponding sliding slots. A shaft sleeve is arranged around a middle portion of each rotating shaft. Two nuts are fixedly connected to the lower parts of the two rotating shafts respectively, and engaged with two threaded end portions of a spindle respectively. The external threads at the two threaded end portions are contrary in their styles. A knob is arranged at one end of the spindle. A guiding bracket assemble with guiding slots, along which two opposite ends of the spindle can slide, is arranged in the housing. The driving device comprises at least one stepping motor which is directly coupled with one end of the rotating shaft or is coupled with the rotating shaft via a speed changing device. The stepping motor is fixed to a base plate and provided with a gear on a main shaft thereof which engages with another gear arranged on the end of the rotating shaft. The base plate can slide along sliding slots parallel with the above sliding slots. One or both of the rotating shafts are coupled with the driving device so as to be driven synchronously. The circuit board is connected to a computer device. The inkjet-printing unit, the rotating shafts, the driving device and the circuit board are located in the housing, and the computer device is integrated into the housing or is arranged outside of the housing.

DETAILED DESCRIPTION OF THE INVENTION

Figure 1:
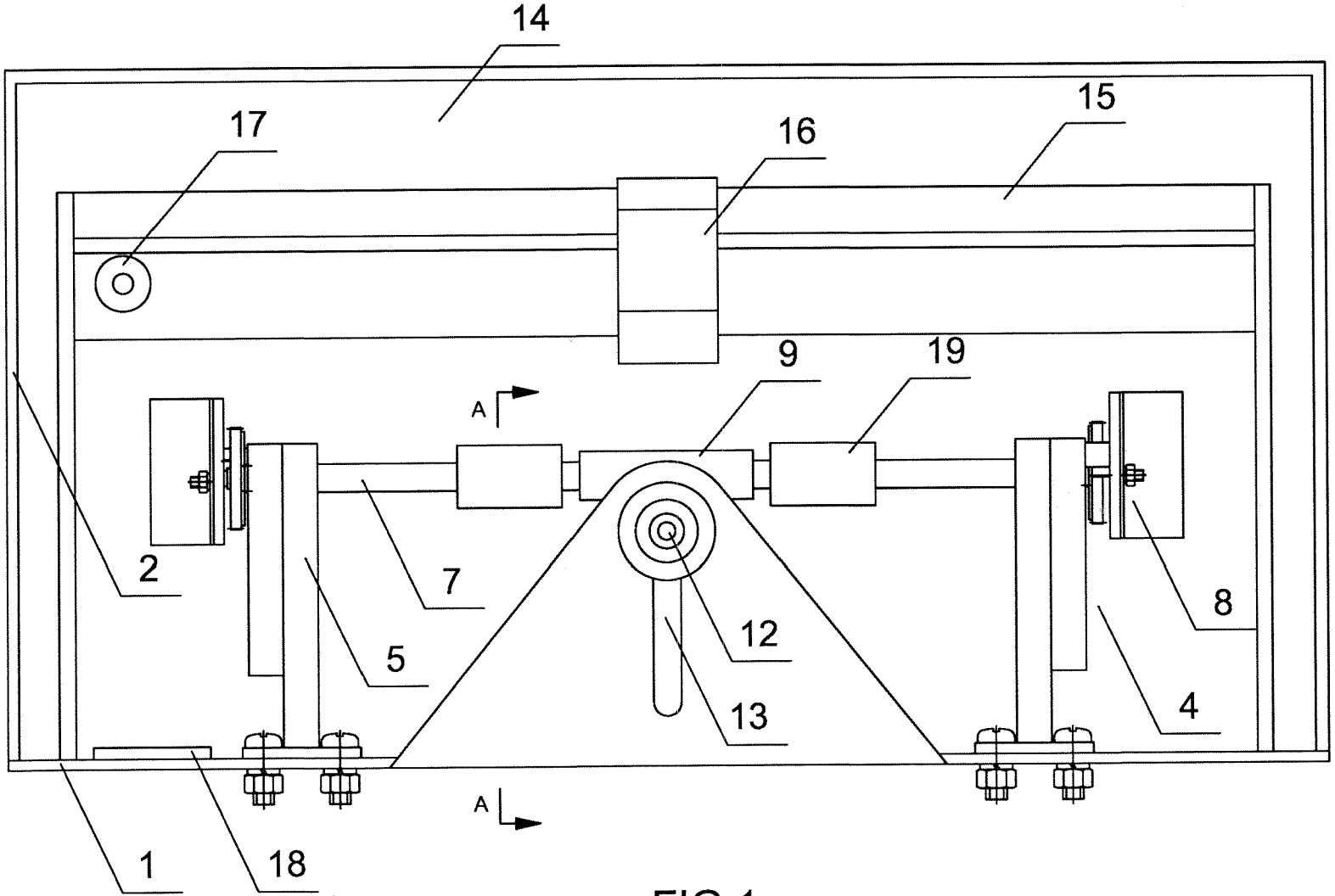
FIG. 1 is a front view of the present invention.
Figure 2:
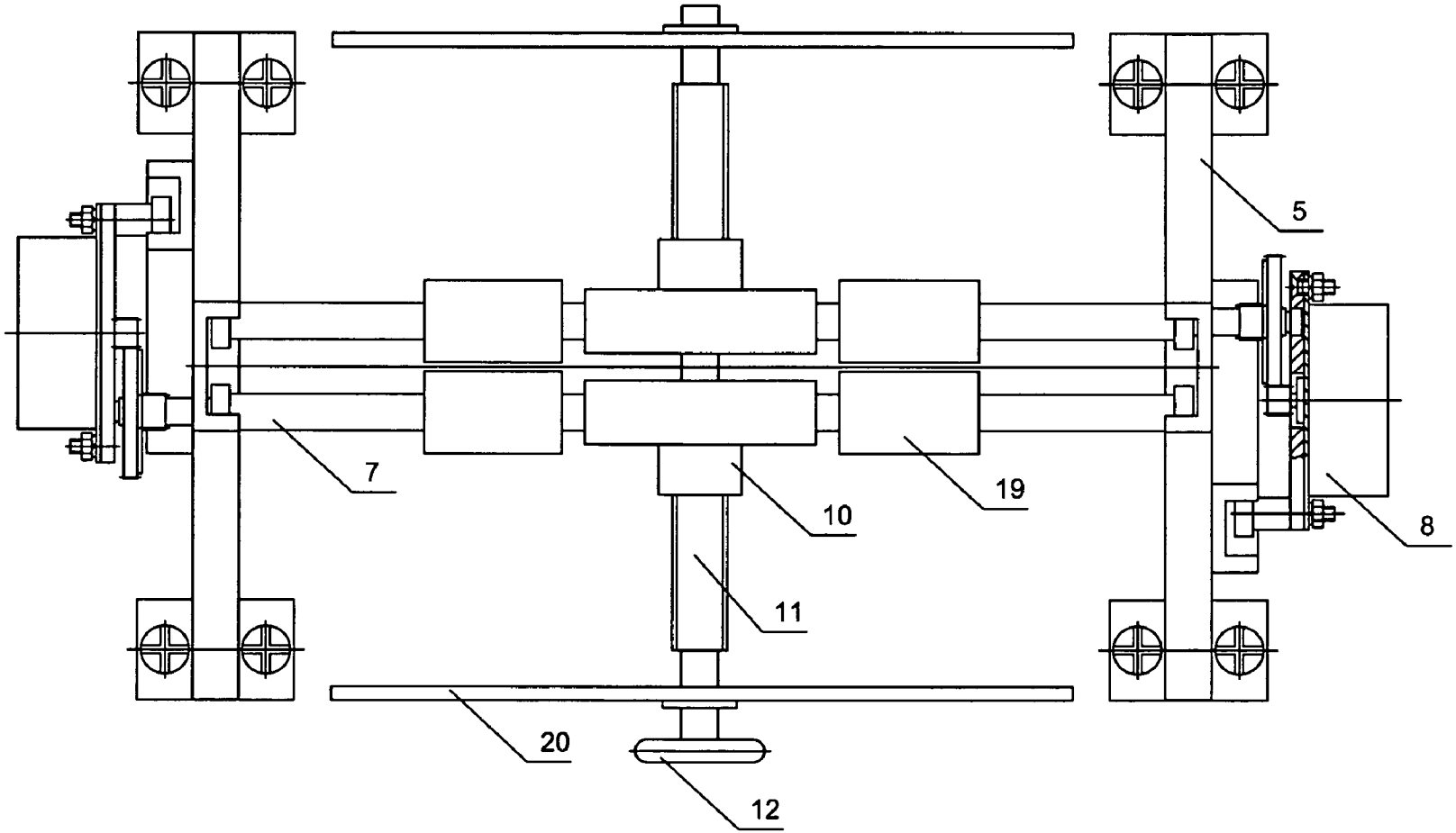
FIG. 2 is a top view of the device shown in FIG. 1 with the printing unit removed.
Figure 3:
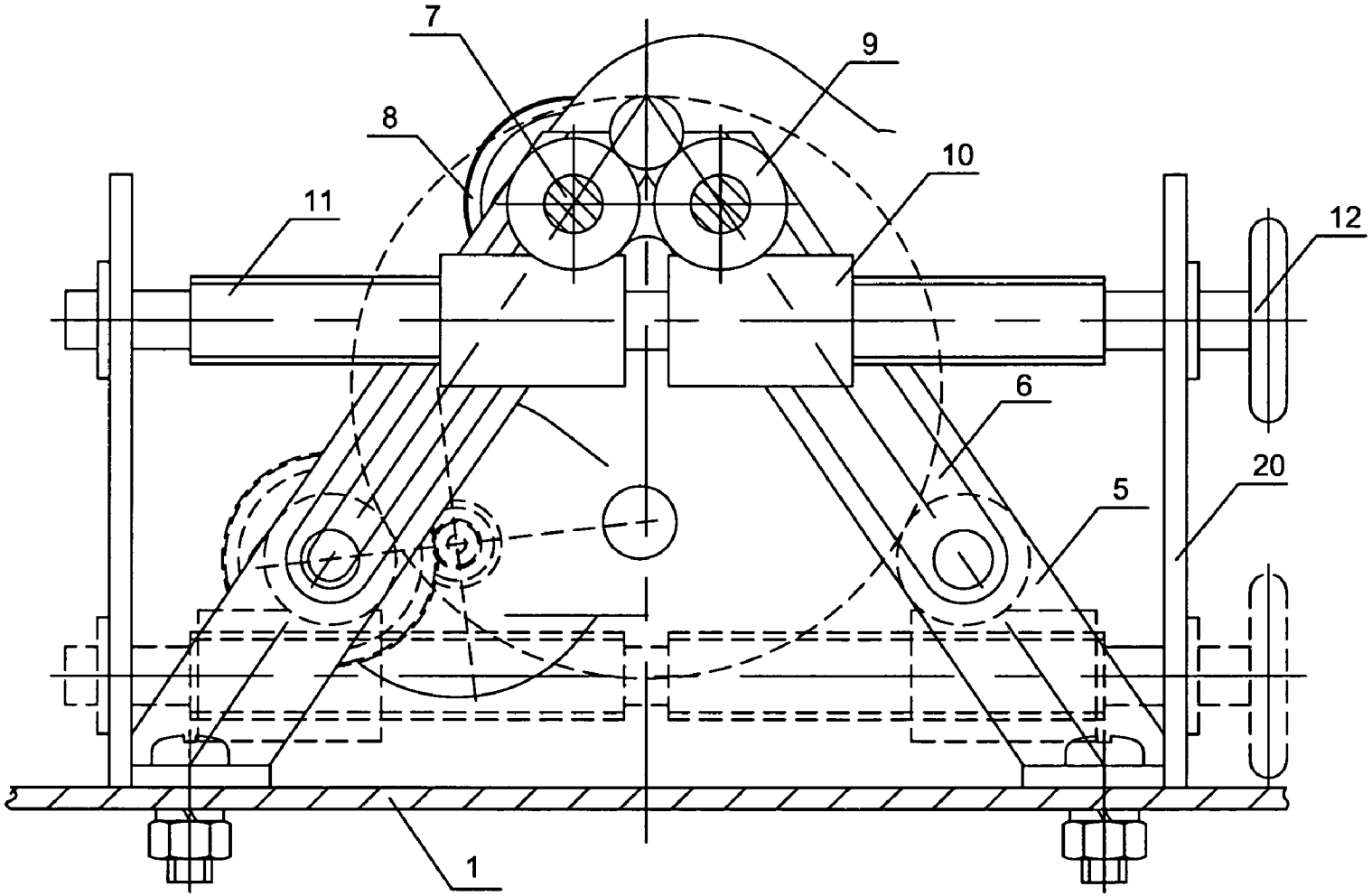
FIG. 3 is a sectional view of the device shown in FIG. 1 taken along line A-A.

As shown in FIGS. 1, 2 and 3, the device of the present invention includes: a base 1, an upper shell 2 arranged on the base 1 and fixed to the base 1 on its periphery, and a cover (which is well known in the art and not shown in the drawings) provided on the upper shell 2 and articulated to the upper shell 2. The cover can be flipped over so as to open or close the shell 2 for facilitating operation.

A holder 4 is provided on the base 1 and comprises two sets of "八" shaped legs 5. A sliding slot 6 is provided on the leg 5. Two rotating shafts 7 parallel with each other in the same horizontal plane are arranged on the holder 4. Two opposite ends of each rotating shaft 7 are arranged in inner rings of two bearings. The outer rings of the bearings are slidingly engaged with the sliding slots 6. A stepping motor 8 is arranged in a portion of one end of each rotating shaft 7 extending beyond the corresponding sliding slot 6.

A shaft sleeve 9 is arranged around the middle portion of each rotating shaft 7, and a nut 10 is fixedly connected to the lower part of the shaft sleeve 9. Two nuts 10 are respectively engaged with two threaded end portions of a spindle 11. The external threads at the two threaded end portions are contrary in their styles. A knob 12 is provided at one end of the spindle 11. A guiding bracket assemble 20 with guiding slots 13 is fixedly arranged on the base 1, and the two ends of the spindle 11 extend through the guiding slots 13.

A printing unit 14 is arranged on the base 1 and comprises a printing bracket 15. The printing bracket 15 is provided with a printing head 16 and a printing motor 17 for driving the printing head 16 to reciprocate linearly relative to the printing bracket 15. The printing unit 14 is located above the holder 4.

The stepping motor 8 and the printing motor 17 are coupled with a circuit board 18. The circuit board 18 is fixed to the base 1 and provided with an outer interface on the shell 2 for being coupled with a data line of an outside computer device. Furthermore, the stepping motor 8 and the printing motor 17 are respectively provided with a socket on the shell 2 for being coupled with a power supply.

In use, the outer interface of the circuit board 18 is first coupled with the computer device via a data line, and the stepping motor 8 and the printing motor 17 are connected with the power supply. Then, the computer is powered on. Subsequently, the printing unit is detected by a driving software and is in a waiting state after initialization.

The cover is flapped over to open the shell 2 and the knob 12 is rotated. The two nuts 10 and the shaft sleeves 9 are moved outwards or inwards by the spindle 11. With the movement, the two rotating shafts 7 are moved symmetrically with each other and moved synchronously upwards or downwards in the vertical direction by means of the guiding slots 6, which are arranged in a shape of Chinese character "八", so that the rotating shafts 7 can be adjusted to suitable levels. The rotating shafts 7 can be automatically locked in position by the screw thread fit.

A cylindrical candle to be printed needs to be disposed between the two rotating shafts 7. The spacing between the rotating shafts 7 and the heights thereof are adjusted again until the distance from the highest point of the candle to the printing head 16 is optimized. The images and/or characters to be printed can be self-defined or selected in the computer. Subsequently, a "Printing" instruction can be sent to the printing unit to drive the printing motor 17, whereby the printing head 16 reciprocates and injects ink which then adheres to the surface of the candle. At the same time, the two stepping motors 8 are rotated synchronously and the candle are rotated by the rotating shafts 7 so that the foregoing preset images and/or characters are formed on the candle.

The spacing between the two rotating shafts 7 and the heights thereof can be adjusted so as to adapt to the candles with different diameters. The maximum and minimum diameters of the candles to be printed are shown respectively by a solid line and a dotted line in FIG. 3.

Rubber sleeves 19 can be disposed adjacently to the opposite ends of each rotating shaft 7 so as to prevent the images and/or characters printed on the candle from being rubbed out by the rotating shaft during rotation. The rubber sleeves 19 can slide along the rotating shafts 7 in the axial direction, so as to contact with the candle in a position located the outside of the printing area of the candle.

With the construction of the present invention, a cylindrical candle can be disposed between the two rotating shafts 7. Since at least one of the rotating shafts 7 is connected to the driving device, the candle can be rotated by the rotating shafts 7, and the reciprocating printing head 16 can print images and/or characters on the outer peripheral surface of a cylindrical candle. Since the horizontal distance between the two rotating shafts 7 can be adjusted, and the rotating shafts 7 or the holder 4 on which these shafts 7 are located can move relative to the printing bracket 15 in the vertical direction, they can adapt to the candles with different diameters, and thus the distance between the highest points of the candles and the printing head 16 can be kept optimal by adjustment. The sliding slots 6 are oblique and are provided in the holder 4 mounted with the rotating shafts 7, the shaft sleeves 9 is provided in the central portions of the rotating shafts 7 respectively, the two nut 10 are fixed to the lower portions of the shaft sleeves 9 respectively and engaged with two threaded end portions of the spindle 11 respectively, and the external threads at the two threaded end portions are contrary in their styles. Thereby, the height of the two rotating shafts 7 and the horizontal distance therebetween can be adjusted by screwing the spindle 11, and the self-locking can be achieved by the screw thread fit.

The present invention has a simple and flexible construction, is easy to operate, and can be used to print golden, silvery, white and color images and/or characters. In combination with a computer with a powerful pattern/character processing function, the present invention can be used to print self-defined color images and/or characters on candle to satisfy various personalized requirements of the people. The images to be printed can be freely updated and self-defined on line in terms of vogue and fashion.

It can be seen from the above description that the present invention can be used to print patterns and/or characters on candle. These articles with patterns and characters themselves can transmit information to satisfy various personalized requirements of the people.

It should be noted that the previously described embodiments of the present invention can be changed or modified in various manners. For example, only one rotating shaft 7 is a driving shaft and the other is a driven shaft. Alternatively, the stepping motor 8 can be coupled with the rotating shaft 7 via a speed changing device and slide in a sliding slot parallel with the foregoing sliding slots 6. Alternatively, the sliding slots 6 are in the horizontal direction, and the holder 4 can integrally shift relative to the printing bracket 15 in the vertical direction, and so on.

Although the present invention has been herein shown and described with reference to the preferred embodiments, it is to be understood that the invention is not limited to these disclosed embodiments. It is possible for those skilled in the art to make numerous modifications and variations of the present invention based on the embodiments described above, and the invention is intended to cover various modifications and equivalent arrangements included without departing from the spirit and scope of the present invention.

INDUSTRIAL APPLICABILITY

With the construction of the present invention, a cylindrical candle can be disposed between two rotating shafts. Since at least one of the rotating shafts is coupled with the driving device, the candle can be rotated by the rotating shafts, and then the reciprocating printing head can print images and/or characters on the outer peripheral surface of the cylindrical candle. Since the horizontal distance between the two rotating shafts can be adjusted, and the rotating shafts or the holder on which these shafts are located can move relative to the printing bracket in the vertical direction, they can adapt to the candles with different diameters, so that the distance between the highest point of the candles and the printing head can be kept optimal by adjustment. The sliding slots are oblique and are provided in the holder mounted with the rotating shafts, the shaft sleeves are provided in the central portions of the rotating shafts, the nuts are fixed to the lower portions of the shaft sleeves respectively and are engaged with two threaded end portions of a spindle respectively, and the external threads at the two threaded end portions are contrary in their styles. Thereby, the height of the two rotating shafts and the horizontal distance therebetween can be adjusted by screwing the spindle and the self-locking can be achieved by the screw thread fit.

The present invention has a simple and flexible construction, is easy to operate, and can be used to print golden, silvery, white and color images and/or characters. In combination with the computer with a powerful pattern/character processing function, the present invention can be used to print self-defined color images and/or characters on the candle to satisfy various personalized requirements of the people. The images to be printed can be freely updated and self-defined on line at all hours in terms of vogue and fashion.

What is claimed is:

1. A device for printing images and/or characters on a candle including: an inkjet-printing unit comprising a printing bracket on which a printing head is arranged, the printing head making a linear reciprocating movement relative to the printing bracket, wherein two rotating shafts parallel with each other are arranged below the inkjet-printing unit, at least one of the rotating shafts is coupled with a driving device, and the driving device and the inkjet-printing unit are coupled with a circuit board, wherein the rotating shafts are arranged on a holder, the holder comprises two pairs of legs, each pair of which is symmetrically arranged in a splayed shaped configuration and fixed to a housing, a sliding slot is provided in the leg, and opposite ends of each of the rotating shafts are located in corresponding sliding slots respectively.

2. The device for printing images and/or characters on a candle according to claim 1, wherein both the horizontal distance between the rotating shafts and the vertical distance between the holder and the printing unit can be adjusted.

3. The device for printing images and/or characters on a candle according to claim 1, wherein a shaft sleeve is arranged around a middle portion of each of the rotating shafts, a nut is fixedly connected to a lower part of the shaft sleeve, two nuts are respectively engaged with two threaded end portions of a spindle, and external threads at the two threaded end portions are contrary in their styles.

4. The device for printing images and/or characters on a candle according to claim 3, wherein a knob is arranged at one end of the spindle, a guiding bracket assemble with guiding slots is arranged in the housing, and opposite ends of the spindle can slide along the guiding slots.

5. The device for printing images and/or characters on a candle according to claim 4, wherein the driving device comprises at least one stepping motor, and the stepping motor is directly coupled with an end of the rotating shaft or is coupled to the rotating shaft via a speed changing device.

6. The device for printing images and/or characters on a candle according to claim 5, wherein the at least one stepping motor is fixed to a base plate, and gears arranged on a main shaft of the stepping motor engage with gears arranged on the end of the rotating shaft, the base plate can slide along sliding slots parallel with the sliding slots provided in the legs.

7. The device for printing images and/or characters on a candle according to claim 6, wherein one or both of the rotating shafts are coupled with the driving device so as to be driven synchronously.

8. The device for printing images and/or characters on a candle according to claim 1, wherein the circuit board is coupled with a computer device.

9. The device for printing images and/or characters on a candle according to claim 8, wherein the inkjet-printing unit, the rotating shafts, the driving device and the circuit board are located in the housing, and the computer device is integrated into the housing or arranged outside of the housing.

10. The device for printing images and/or characters on a candle according to claim 1, wherein each pair of legs is symmetrically arranged in substantially an "inverted V" shaped configuration.

* * * * *